US005125585A

United States Patent [19]

Williams

[11] Patent Number: 5,125,585

[45] Date of Patent: Jun. 30, 1992

[54] REVERSIBLE HAMMER MILL WITH COMPOUND BREAKER PLATE ADJUSTMENTS

[76] Inventor: Robert M. Williams, 16 La Hacienda, Ladue, Mo. 63124

[21] Appl. No.: 707,748

[22] Filed: May 30, 1991

[51] Int. Cl.[5] ..... B02C 13/09

[52] U.S. Cl. ..... 241/189.2; 241/287

[58] Field of Search ..... 241/189 A, 287, 286

[56] References Cited

U.S. PATENT DOCUMENTS

| | | | |
|---|---|---|---|
| 2,973,909 | 3/1961 | Danyluke | 241/189 A |
| 3,058,676 | 10/1962 | Hermann | 241/189 A |
| 3,630,458 | 12/1971 | Smiley | 241/46.06 |
| 3,637,145 | 1/1972 | Williams | 241/189 A |
| 3,667,694 | 6/1972 | Williams | 241/186 R |
| 4,767,066 | 8/1988 | Williams | 241/27 |
| 4,830,291 | 5/1991 | Williams | 241/73 |

*Primary Examiner*—Mark Rosenbaum
*Assistant Examiner*—John M. Husar
*Attorney, Agent, or Firm*—Gravely, Lieder & Woodruff

[57] ABSTRACT

A hammer mill having a rotor carrying a series of hammers for the reduction of material entering the hammer mill, a casing forming a material receiving inlet opening into a throat space from outside the mill, a rotor having hammers traveling in a circular path below the material inlet, the rotor being free to rotate clockwise and counter clockwise, breaker plates positioned one on each side of the material receiving throat space, and having upper and lower end portions, first adjustment provisions operably connected to the upper portions of each of said breaker plates in position for moving said breaker plate upper portions in toward or away from said throat space, second adjustment provisions operably connected to the lower portions of each of said breaker plates for positioning the lower portion of said breaker plates in a selected position relative to the hammer circular path, and said first and second adjustment means acting to support the respective breaker plate to which each is connected and effecting redirection of the material to promote a down draft to draw especially light weight particulates into the grinding rotor so the recirculation energizes the continuation of the down draft.

10 Claims, 2 Drawing Sheets

FIG. 1.
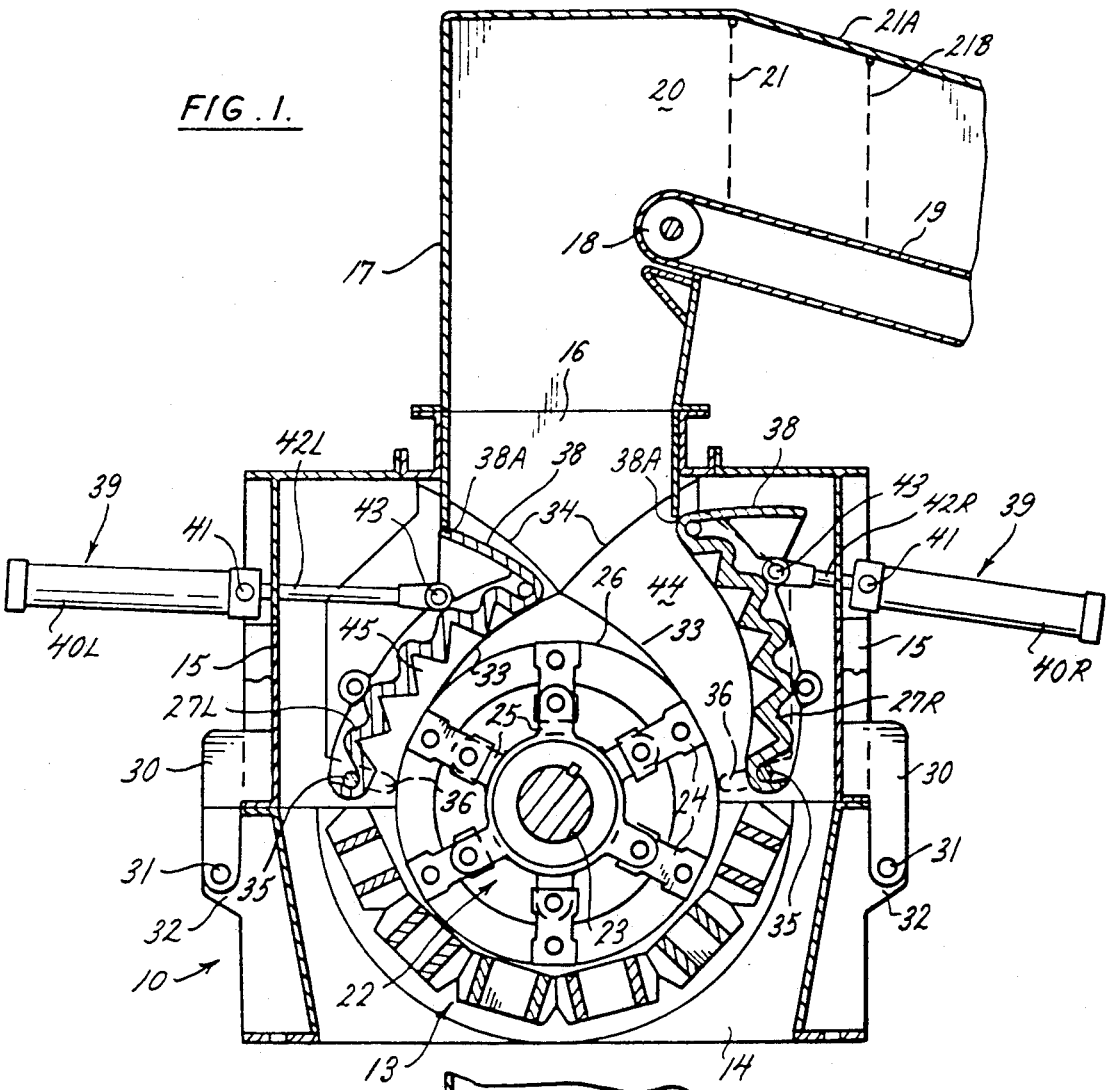
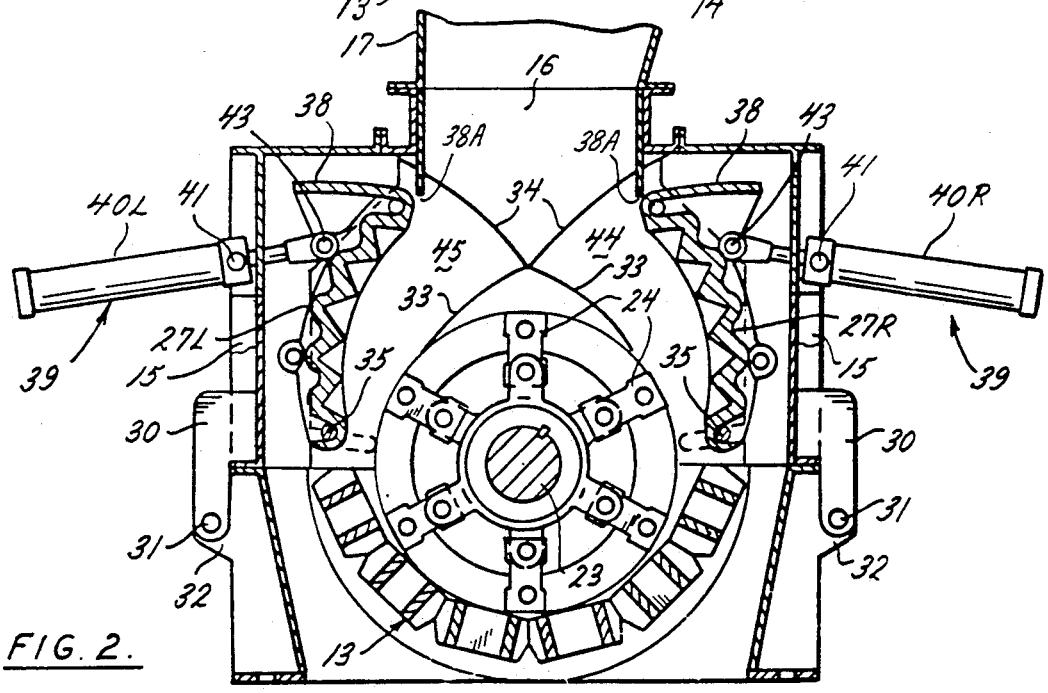
FIG. 2.

REVERSIBLE HAMMER MILL WITH COMPOUND BREAKER PLATE ADJUSTMENTS

BACKGROUND OF THE INVENTION

1. Field of the Invention

This invention relates to a reversible hammer mill having compound adjustable breaker plates that are able to handle bulky and large size objects as well as trash and light weight material requiring reduction in a downdraft pass through the mill.

2. Description of the Prior Art

A consistent problem with prior art hammer mills is that the breaker bars and plates are installed with limited ability to provide an opening large enough to receive bulky objects irrespective of the direction of rotation of the hammer rotor. This problem is typical of such prior art mills as are shown in Stine et al Pat. No. 2,411,302 of Nov. 19, 1946 or West Pat. No. 2,767,929 of Oct. 23, 1956 or Fawcett Pat. No. 2,977,055 of Mar. 28, 1961 or Williams Pat. No. 4,767,066 of Aug. 30, 1988.

While reversibility of a hammer rotor is desirable, the construction of hammer mills capable of being reversed has resulted in complicated and expensive provisions to achieve reversibility while not providing any protection for the conveyor head shaft feeding the mill. One example is seen in Williams Pat. No. 3,667,694 of Jun. 6, 1972 which is provided with an elongated feed stack and protective curtain for the feed conveyor when difficult objects are to be reduced by the rotating hammer action. Other examples of expensive mill construction that do not protect the headshaft of a feed conveyor are seen in Stram et al Pat. No. 4009836 of Mar. 1, 1977 and Williams Pat. No. 4,830,291 of May 16, 1989. The Williams mill provides special features of construction to avoid the effect of blowback into the feed opening but does not prevent the impingement of uncrushables on the head shaft of the conveyor.

SUMMARY OF THE INVENTION

A principle object of the invention is exemplified in a reversible hammer mill having a central feed opening relative to the hammer rotor, and opposite breaker plates that are adjustable at either the top or at both top and bottom to assume selective positions relative to the hammer rotor to control blowback when processing loose material as well as to open the inlet so that large size objects are able to move into the rotor for reduction.

Another object is to provide a configuration of breaker plates in the grinding chamber and throat area that have the effect of routing particulate material back into the orbit of the rotating hammer to prevent blowback in the entrance and surging of the flow of material into the rotor.

A further object is to position the breaker plates so that uncrushables are not thrown out into the feed space to impurge upon the end of the conveyor delivering material.

Another object is to control the placement of the breaker plates in the mill so the light weight material is drawn into the rotor rather than blown out, while large, bulky objects can be drawn into the mill.

A further object is to provide a reversible hammer mill with breaker plates that have two adjustment provisions to permit compounding the adjustability of the breaker plates so the mill is able to accommodate a large variety of materials.

Other objects of the invention will be pointed out in the description of the mill seen in the drawings.

BRIEF DESCRIPTION OF THE EMBODIMENT

A reversible hammer mill having the novel features of the invention is set forth in the drawings wherein:

FIG. 1 is a sectional elevation of a reversible hammer mill having the desired features of construction;

FIG. 2 is a modified sectional view showing the breaker plates in an open position;

DETAILED DESCRIPTION OF THE EMBODIMENT

Figure 3:
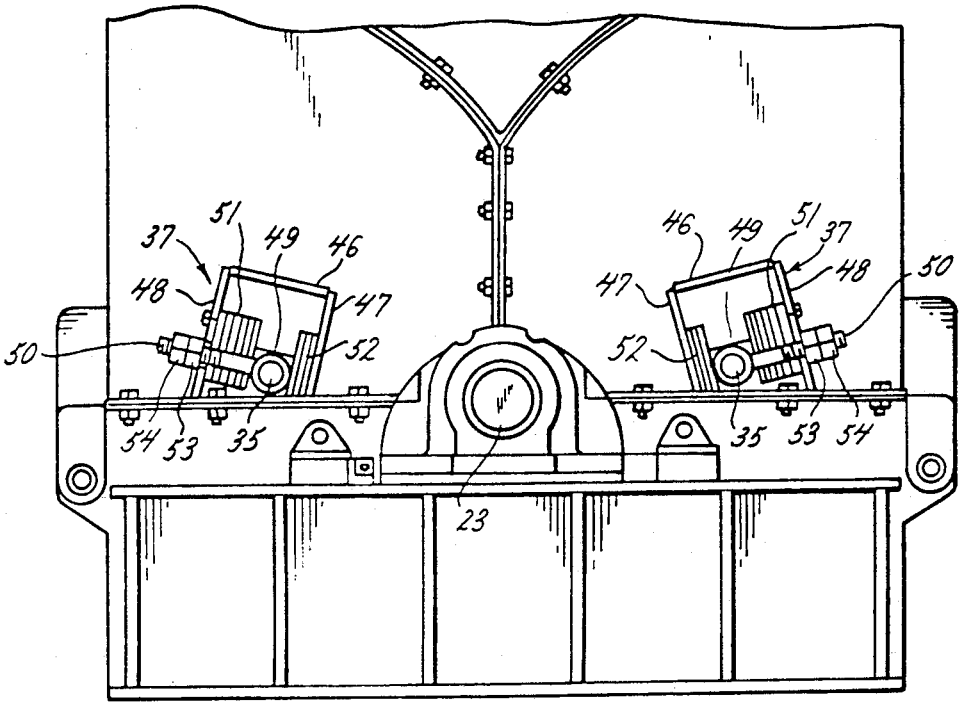
FIG. 3 is an elevation view from one end showing the exterior of part of the mill of FIG. 1.

There is seen in FIG. 1 a sectional elevational view of the preferred mill having a base frame 10 which carries the discharge grates made in sections 11, 12 and 13 mounted in the usual way to frame the ground material outlet 14. The base frame 10 supports a pair of hinged casing assemblies 15 which cooperate with a middle structure represented by the material feed inlet 16 which forms a throat space between the casing assemblies. A part of the middle structure is not shown to avoid complicating the drawing. On top of the feed inlet or throat space 16 is a housing 17 which supports the head shaft of rotor 18 of the feed conveyor 19 in a material receiving inlet side opening 20 of the housing. The feed inlet opening is provided with a curtain 21 to retain objects that are flung upward in the housing 17 through the mill material feed opening 16. In addition, a cover 21A for the conveyor 19 supports a second curtain 21B.

The mill seen in FIG. 1 is provided with a rotor assembly 22 mounted on a shaft 23. The assembly 22 includes a series of hammers 24 pivotally attached to carriers 25. In rotation the hammers 24 follow a circular path, the maximum circumference is on the circle 26. The rotor assembly 22 is constructed so it can be rotated in either 9 clockwise or 9 counterclockwise direction. The selection of the direction of rotation of shaft 23 is determined in most cases on which position of the breaker plates 27 is selected. In FIG. 1 the breaker plate 27R is opened up relative to the rotor assembly 22, while the breaker plate 27L is closed down relative to the rotor assembly 22. In these positions, the breaker plate 27L prevents particulate material being thrown upwardly in the housing 17 where it could damage the conveyor head shaft of rotor 18. It is noted that the breaker plates 27R and 27L can have reversed positions, or positions intermediate thereof.

Each casing assembly 15 has a hinge 30 connected by hinge pin 31 to the flange 32 formed on the base frame 10. Also, each casing assembly has a first parting edge 33 and a second parting edge 34, both of which close against similarly formed edges on an inlet structure 16. Furthermore, each casing supports a breaker plate 27 (hereinafter designated 27R and 27L) having a curved configuration to substantially match the hammer path represented by the circle 26. Each plate 27R and 27L is movable about a lower pivot shaft 35 that extends to the exterior of the casing assembly 15 and is adjustable in a direction along a slot 36 in a side wall of the casing assembly 15. The adjusting means 37 is mounted on the outside of the casing assembly 15 as is shown in FIG. 3 and will be detailed in that showing.

Figure 4:
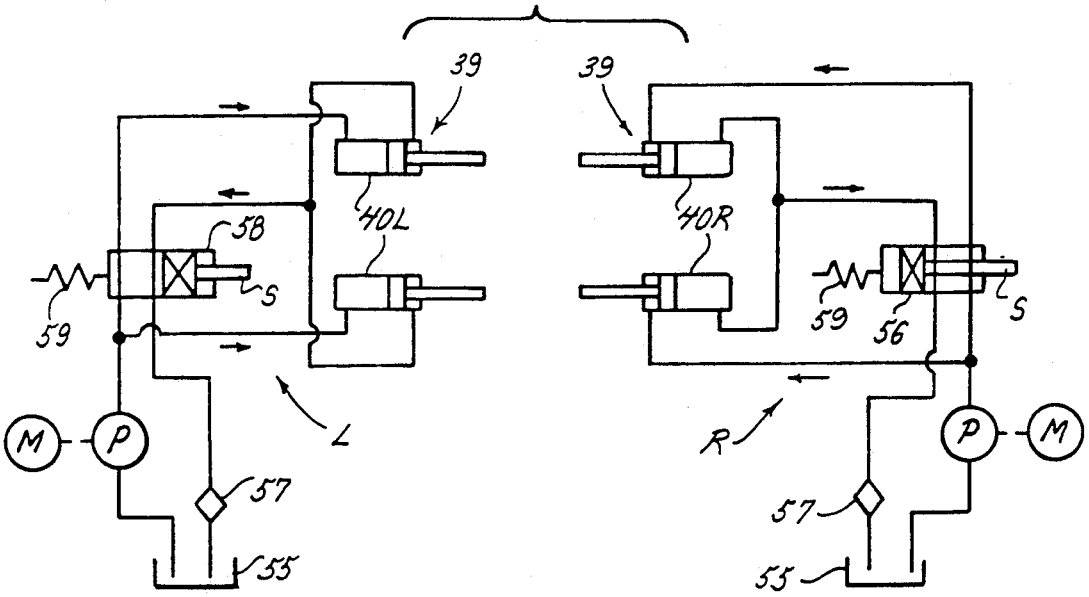
FIG. 4 is a schematic diagram of a control system for controlling the selective positioning of the breaker plates.

The breaker plates 27R and 27L are formed at the upper ends with a cutoff wing 38 which is suitably curved relative to a center defined by the lower pivot 35. Thus, as the breaker plate moves, the wing 38 passes the bottom edge 38A of the frame that forms inlet 16 without interference. The wing 38 is long enough to prevent incoming material escaping behind the breaker plate when the breaker plate is in its closed setting. Position adjustment of each breaker plate is obtained by hydraulic piston motor means 39 consisting of a cylinder 40R and 40L is pivotally mounted at 41 on the casing assembly 15 and its piston rod 42R and 42L extends through the side wall of the casing and is pivotally connected at 43 to the back of the breaker plate 27. The motor means 39 is shown in FIG. 4 in more detail.

The view of FIG. 1 illustrates the selective positioning of the breaker plates 27 in which breaker plate 27R at the right is drawn back to open a venturi passage 44 that narrows in cross section as it proceeds down to the top of the grate 13. The opposite breaker plate 27L is shown moved in toward the circular path 26 of the hammers 24 so its inner face defines a venturi passage 45 of considerably restricted cross section which functions to direct particulate material into the venturi passage 44 where it immediately reenters the orbit of the hammers for further reduction against the grate. The fan effect of the hammers in clockwise rotation create a negative pressure in the venturi 44 which sucks the light weight particulates into the hammers for rapid reduction and exit through the grate. In this view the pivot shaft 35 for the lower end of the breaker plate 27L can be held in a fixed position with the adjacent end of the breaker plate 27L spaced farther from the path of the hammers than the upper end supported by the motor means 39.

FIG. 2 illustrates a different selection of positioning of the breaker plates from that shown in FIG. 1. Here, the breaker plate 27L is drawn back to a position that matches the breaker plate 27R so the throat space 16 is opened to a maximum to accommodate large bulky objects. The reception of bulky material and such objects have sufficient density to cause their entrance into the hammer rotor and promote a downdraft effect in the throat 16.

In FIG. 3, there is shown a shim type adjusting means 37 connected to each end of the pivot shafts 35 that extend to the outside of the casing assembly 15 through the slot 30. The ends of shaft 35 are in a housing 46 having walls 47 and 48. The shaft 35 includes an eye bolt 49 in which the shaft end 35 is received (only one end of the pivot shaft 35 needs to be disclosed). The threaded stem 50 of the eye bolt 49 extends past one or more outer shim plates 51 which are positioned between the eye bolt 49 and the wall 48 on the casing assembly. Other shim plates 52 are located between the eye bolt 49 and the inner wall 47 of the housing. By adding and removing or exchanging shims 51 and 52, the shaft 35 can be located as desired. Adjusting nuts 53 and 54 are threaded up on the bolt stem 50 and one of the nuts can function as a jam nut to hold the lower end of either breaker plate in any of its adjusted settings.

It is desirable at times to operate the respective motor means 39 independently of each other so the breaker plates 27R and 27L can be both retracted to provide a large throat for large materials, or closed down relative to the hammer rotor 22. The position of the breaker plates shown in FIG. 1 has one plate 27L closed down on the hammer circle 26 while the opposite plate 27R is drawn back to form a wedge shaped venturi passage 44 for the material when the hammer rotor 22 is turning clockwise. The reverse condition will obtain when the rotor 22 turns counter clockwise. The view of FIG. 1 shows the right hand breaker plate 27R drawn back at both top and bottom and the left hand breaker plate 27L moved in, at least, at the top so material carried around by the hammers 24 in a clockwise direction creates a negative effect in the inlet venturi 44 to thereby suck lighter material into the grinding chamber. The venturi effect in passage 44 is enhanced by the weight of solids to air ratio upon recycling the uncrushables.

The view of FIG. 4 is a schematic circuit arrangement for providing fluid pressure control means, normally positioned close to the mill so as to be connected by flexible conduits for effecting the positioning of the breaker plates 27R and 27L. In this embodiment the piston rods project through the side walls of the casing 15 so the inner ends can be pivotally connected at 43 to the respective breaker plates 27R and 27L. The respective cylinders 40R and 40L are pivoted on the side walls to accommodate the pivoting movement of the breaker plates in the casing 15. A pair of such cylinder-piston motor means 39 is shown. The cylinders and piston represent motor means 39 for adjusting the position of the respective breaker plates. The motor means, therefore, of FIG. 4 are shown to agree with the retracted position of breaker plate 27R and the substantially most inward position of breaker plate 27L. Control circuits R and L are provided.

In known practice, the circuit R operates to have a pump P draw fluid from reservoir 55 and deliver the fluid through a reversing valve 56 of known character to supply the pressure fluid conduits connected to the motor means 39 so such means will move the associated breaker plate 27R to open position. The reason for a pair of motor means 39 is that the breaker plates 27R and 27L can have sufficient length to require a pair so that twisting of the breaker plates is prevented. While the pressure fluid displaces the pistons 40R and 40L, the displaced fluid is returned through a filter 57 to the reservoir 55. At the same time circuit L has been operated to achieve the position of breaker plate 27L of FIG. 1. This is understood to have the pump P supply fluid through the reversing valve 58 so the motor means 39 will extend the piston rods 42, while the fluid behind the pistons is displaced through the valve 57 to collect in reservoir 55 after being filtered by means 56.

In each circuit R and L the reversing control valve 56 or 58 is urged in one direction by a suitable spring 59 and a solenoid S is provided to oppose the spring to shift the valve to obtain a desired effect in the circuit on the motor means 39 for locating the associated breaker plate. The two circuits R and L are independent so the associated breaker plates 27R and 27L respectively can be separately adjusted from the position in FIG. 1 to the position in FIG. 2, or to any other adjustment that is desired.

What is claimed is:

1. In a hammer mill having a rotor carrying a series of hammers for the reduction of material entering the hammer mill, the improvement comprising:

(a) a casing forming a material receiving inlet opening into a throat space;

(b) a rotor having hammers travelling in a circular path below the material inlet, said rotor being free to rotate clockwise and counter clockwise;

(c) breaker plates positioned adjacent and below each side of the material receiving throat space, and having upper and lower end portions;

(d) adjustment means operably connected to the upper portions of each of said breaker plates in position for moving said breaker plate upper portions in toward or away from said throat space;

(e) pivot adjustment means operably connected to the lower portions of each of said breaker plates for retaining the lower portion of said breaker plates in a desired position relative to said hammer circular path; and (f) said adjustment means and pivot adjustment means act together to support the respective breaker plate to which each is connected.

2. The hammer mill improvement set forth in claim 1 wherein said adjustment means comprises pressure fluid motor means operably connected to the upper portion of each of said breaker plates.

3. The hammer mill improvement set forth in claim 1 wherein said pivot adjustment means is provided with manually adjustable means connected to the lower portion of each of said breaker plates.

4. The hammer mill improvement set forth in claim 1 wherein said adjustment means and said pivot adjustment means are selectively operable on said breaker plates for positioning said upper portions of said breaker plates with one moved to open said throat space and the other moved to effect a partial closure of said throat space for directing material carries by said rotor hammers past said breaker plate.

5. The hammer mill improvement set forth in claim 1 wherein a housing extends over said material receiving inlet opening, conveyor means having a material delivery end in said housing for passage into said inlet opening, and said first adjusting means in operable to position said breaker plates so material moved by said rotor hammers avoids bombarding said delivery end of said conveyor means in said housing.

6. In a hammer mill having hammer carrying rotor means in a casing formed with a material inlet opening to a throat space, the improvement comprising:

(a) a grate assembly mounted in said casing defining an outlet for reduced material, said grate assembly having upper ends at opposite sides of the hammer carrying rotor;

(b) breaker plate means having first ends positioned adjacent said upper gate ends at each side of said hammer rotor and opposite ends extending from said first ends of said rotor toward said inlet throat space; and (c) means for adjusting the position of each breaker plate, said adjusting means moving said upper end of a first one of said breaker plates into a position forming a venturi passage in said throat space for drawing material into said hammer rotor, and said adjusting means moving the said upper end of said other one of said breaker plates into a position approaching said hammer rotor to direct material moved past said gate assembly by said hammer rotor into said venturi passage in said throat space, thereby retaining material that has moved past said gate assembly and producing a down draft through said mill.

7. The improvement set forth in claim 6 wherein said means for adjusting the position of each breaker plate also includes manually operable means connected adjacent said upper ends of said grate assembly at opposite sides of said hammer rotor for varying the position of said breaker plate ends relative to said hammer rotor.

8. The improvement set forth in claim 7 wherein said means for adjusting the position of each breaker plate, and said manually operable means included therewith serve to support said breaker plates in said casing.

9. A hammer mill for reducing material varying from heavy material to light weight material, the hammer mill comprising:

(a) a rotor assembly having hammers connected thereto to move in a circular path;

(b) grate means positioned adjacent said hammer circular path to define a reduced material outlet;

(c) breaker plate means positioned at each side of said rotor assembly and are elongated to extend from lower ends adjacent said grate means in a direction to place the upper curved ends over said circular path of said hammer to other ends above said rotor assembly;

(d) first adjustable means connected to said lower ends of said breaker plate means adjacent said grate means for adjusting the position of said first mentioned lower ends relative to said grate means;

(e) second adjustable means connected to said breaker plate means adjacent said upper ends for positioning said breaker plate relative to said circular path of said hammers; and (f) pressure fluid control means connected to said second ajustable means for positioning said breaker plate means independently of each other relative to said rotor assembly.

10. In a hammer mill having hammer carrying rotor means positioned in a casing between a material inlet opening for material to be ground and a ground material outlet, the improvement comprising:

(a) a grate assembly mounted in said casing to pass ground material at the outlet, said grate assembly enclosing the ground material outlet and having ends at opposite sides of the hammer carrying rotor;

(b) breaker plate means positioned on opposite sides of the rotor and having ends positioned adjacent said grate ends at each side of said hammer rotor and extending from said ends of said rotor toward the material inlet opening;

(c) means for alternately adjusting the position of said breaker plate, said adjusting means moving a first one of said breaker plates into a position forming a venturi passage from the inlet into the rotor for drawing material into said hammer rotor, and said adjusting means moving the other one of said breaker plates into a position approaching said hammer rotor to direct material moved past said grate assembly by said hammer rotor into said venturi passage, for return for further grinding, thereby retaining material that has moved by the rotor hammers past said grate assembly and producing a down draft through said mill; and (d) cut-off wing means carried by said breaker plates in position such that either one of said breaker plates brings its wing means into position to prevent the material escaping in a direction to get behind the breaker plate and avoid entering a venturi passage and into the rotor for reduction.

* * * * *